US012808059B2

(12) United States Patent
Marenco

(10) Patent No.: US 12,808,059 B2
(45) Date of Patent: Nov. 24, 2026

(54) PROCESS FOR REGENERATING CHEMICAL MILLING SOLUTIONS

(71) Applicant: GREEN ETCHING S.R.L., Turin (IT)

(72) Inventor: Claudio Marenco, Rosta (IT)

(73) Assignee: GREEN ETCHING S.R.L., Turin (IT)

( * ) Notice: Subject to any disclaimer, the term of this patent is extended or adjusted under 35 U.S.C. 154(b) by 191 days.

(21) Appl. No.: 18/867,539

(22) PCT Filed: May 19, 2023

(86) PCT No.: PCT/IB2023/055173

§ 371 (c)(1),
(2) Date: Nov. 20, 2024

(87) PCT Pub. No.: WO2023/223278

PCT Pub. Date: Nov. 23, 2023

(65) Prior Publication Data

US 2025/0340998 A1 Nov. 6, 2025

(30) Foreign Application Priority Data

May 20, 2022 (IT) ..... 102022000010520

(51) Int. Cl.
*C23F 1/46* (2006.01)
*C23F 1/36* (2006.01)

(52) U.S. Cl.
CPC . *C23F 1/46* (2013.01); *C23F 1/36* (2013.01)

(58) Field of Classification Search
CPC ..... C23F 1/46; C23F 1/36
See application file for complete search history.

(56) References Cited

U.S. PATENT DOCUMENTS 3,486,954 A 12/1969 Ashcraft

FOREIGN PATENT DOCUMENTS

| | | | |
|---|---|---|---|
| JP | S5044940 | A | 4/1975 |
| WO | 2005095674 | A1 | 10/2005 |
| WO | 2020095191 | A1 | 5/2020 |

OTHER PUBLICATIONS

International Search Report and Written Opinion, issued in PCT/IB2023/055173, mailed Aug. 24, 2023, Rijswijk, NL.
Enzo Strazzi et al., Alkaline etching of aluminum and its alloys—A new caustic soda recovery system, Light Metal Age, Jun. 24, 2002, p. 1-22, AESF, XP055599515.

*Primary Examiner* — Benjamin L Utech
(74) *Attorney, Agent, or Firm* — Valauskas Corder LLC

(57) ABSTRACT

A process for regenerating chemical milling solutions involves introducing a silicon-containing reagent into a solution to establish a molar ratio of Si/Al equal to 1 in the solution. The process further involves letting the silicon and aluminum in the solution react up at least to formation of a phase containing aluminosilicates.

7 Claims, 1 Drawing Sheet

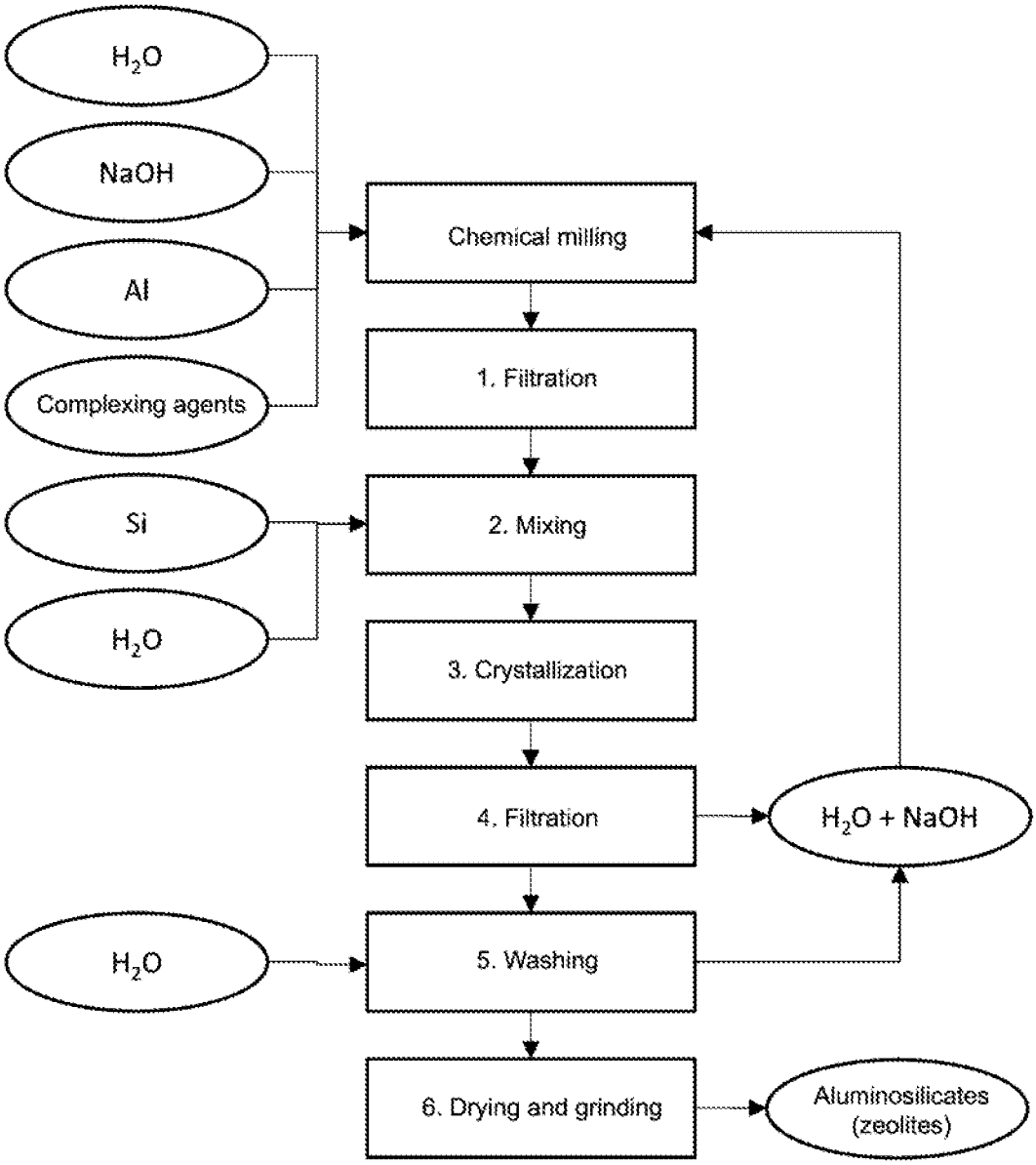
$H_2O$
NaOH
Al
Complexing agents
Si
$H_2O$
Chemical milling
1. Filtration
2. Mixing
3. Crystallization
4. Filtration
$H_2O$ + NaOH
$H_2O$
5. Washing
6. Drying and grinding
Aluminosilicates (zeolites)

PROCESS FOR REGENERATING CHEMICAL MILLING SOLUTIONS

CROSS-REFERENCE TO RELATED APPLICATIONS

This application is a U.S. National Phase filing of PCT International Patent Application No. PCT/IB2023/055173, having an international filing date of May 19, 2023, which claims priority to Italian Patent Application No. 102022000010520, filed May 20, 2022 each of which is hereby incorporated by reference in its entirety.

TECHNICAL FIELD

The present invention is, in general, in the field of metal treating; in particular, the invention relates to a process for regenerating chemical milling solutions.

SUMMARY OF THE INVENTION

Processes for chemical milling of aluminum semi-finished products are known, consisting of treating the surface of the component by immersion in an aqueous solution of caustic soda, which attacks the metal and removes its surface layers. With this technique, cavities or contours may be generated at different depth levels.

In order to achieve the process goals in terms of speed and surface finish, the working solution must be maintained in a defined concentration range of sodium hydroxide, aluminum and any complexing substances.

However, the concentrations vary due to the chemical reactions that occur during the process, with a decrease in the value of sodium hydroxide and an increase in the concentration of aluminum. By contrast, the concentration of complexing agents remains almost constant.

The concentration value of sodium hydroxide may be easily restored by the addition of this compound to the solution, whereas, on the other hand, the removal of aluminum is made difficult by the fact that aluminum remains in solution in the form of sodium aluminate, which has high solubility and is further made stable in solution by the complexing agents present.

Once the maximum aluminum concentration permissible for ensuring the process objectives has been reached, the bath is considered exhausted and what is known as "cutting," i.e., the removal of a portion of the bath with subsequent restoration of the liquid level and sodium hydroxide concentration, must be carried out. The cut-off portion of the bath is then bound for disposal.

As a result, the cutting process is expensive both in terms of the cost of raw materials needed to restore the bath and in terms of disposal costs.

In particular, the chemical milling of aluminum sheets and/or extrusions used in the aerospace sector for the production of aircraft parts (such as wings and fuselages) is mainly done through the use of sodium hydroxide-based alkaline baths, to which various additives may be added to improve the milling process by achieving a specific surface finish, along with an appropriate removal speed/depth.

An example of a milling process of the above type is known from WO 2020095191 A1. This process constitutes a particular type of chemical milling, in which the formulation of the additives is calibrated to increase the level of environmental compatibility of the process and to be able to extend its applicability to areas outside the traditional ones.

Also for this process, the main chemical reaction which takes place during milling is that between sodium hydroxide and the surface of the aluminum component, which is dissolved by forming sodium aluminate and releasing hydrogen gas. The dissolution reaction may be written as shown below:

$$2Al + 2NaOH + 2H_2O \rightarrow 2NaAlO_2 + 3H_2$$

As the reaction proceeds, there is a continuous increase in the concentration of dissolved aluminum in the bath in the form of sodium aluminate and a progressive consumption of free sodium hydroxide. Limited amounts of sodium aluminate do not adversely affect the milling process; on the contrary, a certain concentration of dissolved aluminum in the bath is required to adequately control the process and achieve a homogeneous and uniform surface finish following the removal. If the concentration of sodium aluminate in the bath exceeds a critical concentration so that the chemical equilibrium with the free soda is no longer met, hydrolysis of sodium aluminate may occur, resulting in the precipitation of hydrated alumina and the reformation of sodium hydroxide according to the following reaction:

$$2NaAlO_2 + 4H_2O \rightarrow 2Al(OH)_3 + 2NaOH$$

Increasing within the bath, the hydrated alumina may further go through a dehydration reaction as described below:

$$2Al(OH)_3 \rightarrow Al_2O_3 + 3H_2O$$

The anhydrous alumina thus formed may precipitate to form a hard, tough, and difficult-to-remove crystalline deposit that adheres to the tank walls and to the heating system. This creates problems with the operation of the plant, which must be periodically taken out of service, emptied, and cleaned with excessively long downtime and the risk of damaging the equipment.

Alumina precipitation may be prevented through complexing agent additives that are added to the milling bath. The function of these chemical substances is to keep dissolved aluminum in solution in the bath through a chelation reaction that prevents the sodium aluminate from hydrolyzing, and thus from forming an alumina precipitate.

In this way, the amount of aluminum dissolved in the bath may reach much higher concentrations than standard concentrations (up to even 150 g/l of dissolved Al) depending on the amount of NaOH used, the concentration of additives and the process temperature, without precipitating as alumina.

Maintaining a high aluminum content allows for better control of the reaction, by balancing the removal rate and surface finish to remain within the specifications required by the processing. As the aluminum content increases, the viscosity of the bath gradually increases, the solution adheres better to the components being processed, and a homogeneous and uniform satin finish may be achieved. However, non-negligible drag-out losses of both sodium hydroxide and aluminum may occur.

The process described in the aforementioned document WO 2020095191 A1 falls under this type of bath due to the presence of specific complexing agent additives (mixture of sodium gluconate and sorbitol with defined ratio and concentration limits) that make it possible to keep the concentration of dissolved aluminum high and optimally control the process, ensuring the finish and quality required by the industrial applications of interest.

With the use of chelating agents, the working capacity of the bath is extended, which capacity may be kept within operating ranges by ensuring the balance between the increase in dissolved aluminum, drag-out losses, and sodium hydroxide concentration.

Baths with high concentrations of dissolved aluminum may be considered spent when, due to the decrease in sodium hydroxide concentration and the increase in aluminum concentration, the material removal rate drastically decreases and a poor surface finish may be generated, characterized by pitting zones, preferential corrosion or surface defects. It becomes necessary, therefore, to restore the correct processing parameters by decreasing the concentration of sodium aluminate in the bath and replenishing the consumed sodium hydroxide.

The restoration process normally involves the steps of cutting the bath, with the removal and disposal of the quantity of bath containing the amount of aluminum to be removed, the restoration of the correct volume of bath, and the subsequent restoration of the sodium hydroxide and complexing agent values which were lost by the cutting and previous processing. In general terms, such a principle is known, for example, from WO 2005/095674 A1, although applied to an alkaline solution having significantly different characteristics because it is intended for an application other than a chemical milling process according to the present invention, as will be better appreciated below.

The volumes of cut bath, and the resulting disposal costs, may be decidedly large depending on the amount of material being processed.

One objective of the present invention is to provide a regeneration process suitable for reducing the concentration of dissolved aluminum in the bath, as an alternative to bath disposal, dilution and subsequent equilibration operations.

A further objective of a regeneration process according to the invention is to obtain a precipitate of an aluminosilicate nature that, in addition to decreasing the dissolved aluminum concentrations in the bath, represents a product of industrial interest. In this way, the by-products of the process are not a waste to be disposed of, but a valuable compound that may be modified and processed to obtain zeolites having chemical and physical properties suitable for industrial and commercial applications.

To achieve this, a process for regenerating an alkaline solution for the chemical milling of aluminum semi-finished products according to the invention involves introducing a source of silicon into the solution so as to make an aluminosilicate (zeolites or their precursors) to precipitate and much of the sodium hydroxide in solution to be recovered.

This reduces the amount of sodium hydroxide that needs to be replenished during the process and significantly reduces the environmental impact caused by the disposal of the spent bath, which contains high amounts of dissolved aluminum and other contaminants.

The chemical principle underlying the regeneration treatment according to the invention is the precipitation of aluminosilicates of a zeolitic nature, which is associated with a reduction in the concentration of dissolved aluminum in the bath. The reaction takes place by introducing a source of silicate ions, in a molar ratio of Si/Al equal to 1, which react in an alkaline environment with the aluminate ions to form a gel-phase precursor which, when treated appropriately by controlling the parameters of time (for example 2-3 hours), temperature (preferably, between 6° and 95 °C) and/or pressure (preferably, between 1 and 1.5 bar), evolves into the form of a solid precipitate of high commercial interest. Through suitable mechanical means, known to a person skilled in the art, the precipitated zeolitic phase may be easily recovered and the milling bath reused.

Zeolites are tecto-aluminosilicates of volcanic origin that are formed under hydrothermal conditions in the presence of an alkaline environment, which in nature requires reaction times of hundreds of years. These types of natural materials have various fields of application, ranging from the treatment of civil and industrial wastewater for heavy-metal decontamination, to the use in agriculture as a drainage material and additive to modify soil properties, to applications in the field of industrial catalysis and as an adsorbent or additive material in the cosmetics industry.

It is possible, however, to produce synthetic zeolites having specific and well-determined chemical and physical properties and characteristics, depending on the type of application, that are superior to those of natural zeolites.

The synthesis reaction is a complex process involving a number of different mechanisms, which occur either successively or simultaneously, such as the dissolution of the Si and Al source reagents, condensation, the gelatinization of the aluminosilicate structure and the subsequent crystallization of the zeolite, which are conducted in a controlled manner.

These mechanisms may be grouped into three operational steps: mixing of the chemical reagents to obtain the aluminosilicate precursor solution, development and maturation of the chemical structure through the formation of a gel phase, and crystallization of the precursor solution through a process at high temperature (and possibly at pressures greater than atmospheric pressure).

The necessary conditions for the synthesis of zeolites, therefore, involve a strongly alkaline environment that may be achieved by a mineralizing agent through any alkali metal hydroxide (NaOH, KOH, etc.) and an appropriate reagent mixture that is a source of silicon and aluminum to form a concentrated solution of aluminosilicates that, when treated appropriately, results in the precipitation of zeolites.

A spent solution, resulting from the process according to WO 2020095191 A1 above, is well suited for the production of zeolites, as it has characteristics suitable for such a process. Specifically, a particularly suitable solution for use in a regeneration process of an alkaline solution for the chemical milling of aluminum semi-finished products according to the invention is an aqueous solution of sodium hydroxide (NaOH) in a concentration between 100 g/l and 250 g/l and dissolved metallic aluminum in a concentration between 40 g/l and 90 g/l of solution (preferably, between 50 g/l and 70 g/l). To this solution, an aluminum complexing agent is added, comprising gluconate and sorbitol, each in a concentration between 5 g/l and 25 g/l of solution, wherein the ratio between the concentration of sorbitol (in grams per liter of solution) and the concentration of gluconate (in grams per liter of solution) is between 0.7 and 0.75. In other words, it is a highly alkaline NaOH (pH>13)-based bath in which there is dissolved aluminum in the form of sodium aluminate, which is maintained in solution by way of complexing agents.

Thus, by adding a source of silicon (organic and inorganic silicates, silica, aluminosilicate minerals, colloidal silica, etc.) in such a way as to establish a molar ratio of Si/Al equal to 1, it is possible to create a stock solution suitable for zeolite precipitation, resulting in a lowering of the dissolved aluminum concentration.

A regeneration process according to the invention thus proposes using the milling bath as a stock solution for the precipitation of aluminosilicate compounds of a zeolitic nature. The objective of this process, then, is both to regenerate the exhausted milling solution so that it may be reused and to obtain a product of great industrial interest by way of a complete process which thus achieves a fully circular economy.

A general chemical formula identifying zeolites may be expressed as follows:

$$M_{\frac{2}{n}}O * [Al_2O_3 * xSiO_2] * yH_2O,$$

where M generally represents a cation of alkali or alkaline-earth metals, n the valence of the relevant cation, and the values of x and y fall within a well-defined range depending on the specific type of zeolite.

The regeneration process, on the other hand, focuses on the ability of interaction between the silicate ions and the aluminate ions, which in an alkaline environment react to form a compound that, when treated according to appropriate parameters of temperature, time and pressure, precipitates in the form of zeolite.

Generally, synthetic zeolites are produced in their sodium form so, in an alkaline environment where sodium hydroxide is used, as is the case in the chemical milling of aluminum semi-finished products, the reaction scheme may be described as:

$$2Na^+ + nSi(OH)_4^- + 2Al(OH)_4 + wH_2O \rightarrow Na_2O * [Al_2O_3 * nSiO_2] * mH_2O$$

$$\text{With } w = m - 2(n + 2).$$

Experimental evidence has shown that the presence of the complexing agents in a solution as described above has no influence on the reaction, which remains unchanged within the concentration limits of these agents, so that, despite their presence, this process may be used to regenerate the milling bath, by removing the excess of aluminum in solution and restoring the sodium hydroxide values, and for the production of synthetic zeolites, by appropriately treating the bath with the correct amount of silicon in relation to its specific composition.

A milling solution may be considered spent when the concentration of dissolved aluminum in the bath is so high that the milling reaction is inhibited or excessively slowed. A chemical milling process performs best in terms of speed of execution and quality of surface finish when the concentration of aluminum [$Al^{3+}$] is within a defined range. The lower limit of the range is between 40 and 50 g/l, below which surface roughness may deteriorate. The upper limit of the range is between 60 and 90 g/l, above which the speed of the chemical milling process is not appropriately controlled, and preferably, depending on the type of processing, when it does not exceed 70-80 g/l.

For the regeneration of the milling bath, it is preferable to act on a portion of the bath that is such that it contains the amount of aluminum necessary to lower the overall aluminum concentration to a value (preferably, the lower limit mentioned above) that allows for correct treatment to be executed. If, for example, one wanted to work in a range of aluminum concentration between 50 and 75 g/l, it would be possible to perform the regeneration when the aluminum concentration reaches 75 g/l, and then remove the aluminum (preferably substantially completely) from a portion of the bath equal to about ⅓ of the volume of the total solution, so that the aluminum concentration in the entire solution is restored to 50 g/l.

The aforesaid and other objectives and advantages are achieved, according to an aspect of the present invention, by a process for regenerating chemical milling solutions as described and claimed herein. Preferred embodiments are also described.

BRIEF DESCRIPTION OF THE DRAWINGS

The functional and structural features of some preferred embodiments of a regeneration process according to the invention will now be described. Reference is made to the attached FIGURE, which shows a preferred embodiment of a regeneration process according to the invention.

DETAILED DESCRIPTION

Before explaining in detail a plurality of embodiments of the invention, it should be clarified that the invention is not limited in its application to the design details and configuration of the components presented in the following description or illustrated in the drawings. The invention may assume other embodiments and be implemented or constructed in practice in different ways. It should also be understood that the phraseology and terminology have a descriptive purpose and should not be construed as limiting.

With reference, by way of example, to the FIGURE, a process for regenerating alkaline solutions for the chemical milling of aluminum semi-finished products, according to an embodiment of the invention, includes the following steps: initial filtration to remove impurities and sludge from the portion of the spent bath on which the process is performed, mixing of the bath with a sodium silicate solution, crystallization, filtration to separate the solid/crystalline phase and recovery of a soda solution, washing to remove excess alkalinity from the solid phase and recover an additional amount of soda, and drying and grinding of the solid precipitate.

According to one embodiment of the invention, the initial filtration step includes the step of removing processing sediment that results from the precipitation of oxides of other metallic elements present in the alloy, such as Zn, Cu, Mg, Fe, or other contaminants present as impurities and any oils and/or fats present on the surface of the components to be subjected to milling. Such waste sediment, also called sludge, may be separated by ensuring sufficiently long settling times (in the order of 10-12 hours, for example) so as to make it precipitate to the bottom of the tank and then removed mechanically. Alternatively, it is preferable to centrifuge or filter, for example through a vacuum filter, i.e., a filter press, the amount of bath to be treated so as to separate the sludge and simultaneously purify the bath of any solids in solution. The objective of this preventive filtration is to have a starting bath as clean as possible in order to obtain high-purity synthetic zeolites and minimize contamination by unwanted contaminant elements.

According to one embodiment of the invention, in a subsequent mixing step, the spent milling solution is conveyed to a mixing plant to which a source of silicon is simultaneously added, preferably a sodium silicate solution so as to obtain a mixture with a ratio of Si/Al equal to 1, and, optionally, an appropriate amount of water (preferably between 30% and 50% of the volume of the bath to be regenerated), so as to keep the alkalinity of the bath under control and to establish the correct molar ratios, particularly the ratio of Si/Al, suitable for zeolite precipitation. The addition of water is also advantageous because it makes it possible to work with a more dilute solution, making it easier to mix the sodium silicate solution and bringing the final volume of the regenerated bath, after filtration of the solid phase, closer to the initial volume.

It is preferable to operate in a closed reactor to limit evaporation losses because the production process requires process temperatures close to the boiling temperature of the bath.

Within the reactor, it is appropriate to ensure fast mixing (for example in the order of 1000 rpm), mainly during the first reaction phase between the alkaline milling bath and the silicon source. To facilitate storage, handling and mixing operations, a sodium silicate solution, commonly referred to as waterglass, is preferably used, a choice that is also cost-effective. Mixing between the two solutions may also be conducted at room temperature, but temperatures close to the crystallization temperature, which occurs between 60 °C and 100 °C, allow for better homogenization and reduce the induction time required for crystal nucleation. In fact, it is desirable to ensure the formation of a very homogeneous reactive solution, in which the silicate ions and the aluminate ions are able to adequately dissolve and react to form the gel phase that subsequently evolves into zeolites during the crystallization process.

Initial mixing is protracted until a uniform solution is obtained, that is to say, until any gel particles formed during the addition of the sodium silicate solution are completely dissolved within the solution. At high temperatures, above 90 °C, and through proper mixing, this condition is achieved in a very limited time, generally no more than 30 minutes. At this point, the induction time, that is to say, the time required for all reaction stages to occur until the nucleation of the first crystals, is substantially zero and crystallization may proceed.

According to one embodiment of the invention, crystallization occurs in static mode, although mild agitation (for example in the order of 300 rpm) may be ensured to promote minimal stirring of the stock solution. Therefore, it is not necessary to maintain high agitation after the first homogenization step.

The zeolite crystallization process requires temperatures between 60 °C and 100 °C, and preferably a temperature range of 85 °C to 95 °C. From the process point of view, a temperature around 90 °C is the optimal temperature, both because of issues related to reaction kinetics and because the operating temperatures of the milling process are conducted around this range. In fact, for temperatures below 60 °C the reaction kinetics are very slow and process times that are too long are required, which in some cases may be in the order of several days. Furthermore, for such low temperatures the percentage of crystallinity of the products is extremely low, as mainly an amorphous zeolitic phase is formed. As the temperature increases, the percentage of crystallinity of the zeolites increases dramatically, as does the rate of crystallization of the zeolites. Consequently, the reaction times are drastically reduced at higher temperatures since limited temperature increases result in significantly shorter reaction times, even in the order of hours. In fact, generally, during the regeneration process described, complete crystallization of zeolites may occur within 2-12 h, and preferably crystallization times are reduced to 2-3 h for operating temperatures above 90 °C. During crystallization, a gel-phase colloidal structure is formed, which consists of a polymer-like structure of aluminosilicates that exhibits rheological properties more similar to a solid from which the zeolites develop.

When crystallization is complete, the hydrated zeolitic phase precipitates, and separation of the zeolite crystals from the stock solution may be carried out through a filtration medium. Vacuum filters or filter presses are types of equipment suitable for separating zeolite crystals by dehydrating them efficiently, and allow the stock solution to be recovered, which may be reused as a milling bath once the correct volumes have been re-established and the additive concentration balanced.

After separation from the stock solution, the solid phase may undergo a washing operation that conveniently may be conducted within the filtration plant itself. This operation is adapted to purify the zeolite from excess alkalinity due to the presence of residues of the adsorbed stock solution on the external surface. The washing is performed until the process water has a pH preferably between 9 and 11; this allows for an effluent with a non-negligible amount of hydroxide that may be used during the phase of making up the volume of the milling bath.

Lastly, the washed product may be subjected to a drying/dehydration step to remove residual moisture and obtain a stable solid that may subsequently be crushed and ground to obtain specific dimensions and particle sizes.

Various aspects and embodiments of a regeneration process according to the invention have been described. It is understood that each embodiment may be combined with any other embodiment. Moreover, the invention is not limited to the embodiments described, but may be varied within the scope defined by the appended claims.

Experimental Validation

Tests were carried out with different concentrations of aluminum and sodium hydroxide, with a complexing agent concentration equal to 15 g/l sorbitol and 20 g/l gluconate, achieving (with a molar ration of Si/Al equal to 1) a marked reduction of the aluminum concentration in the recovered bath until almost complete removal.

A table with some of the results obtained in terms of aluminum removal and sodium hydroxide recovery, for different concentrations of the working solution, is given merely by way of example.

| | Molar | Aluminum | | | Sodium hydroxide | | |
|---|---|---|---|---|---|---|---|
| Test | ratio Si/Al | Before (g/l) | After (g/l) | Δ (%) | Before (g/l) | After (g/l) | Δ (%) |
| Bath 1 | 1 | 59.0 | 3.6 | −93.9% | 190.0 | 188.7 | −0.7% |
| Bath 2 | 1 | 69.0 | 2.7 | −96.1% | 204.0 | 200.4 | −1.8% |
| Bath 3 | 1 | 88.0 | 1.8 | −98.0% | 125.0 | 118.0 | −5.6% |
| Bath 4 | 0.75 | 88.0 | 15.0 | −83.0% | 125.0 | 124.0 | −0.8% |

It may be seen that in the claimed working range (i.e., in baths 1 to 3 in the table, in which the concentration of aluminum in the solution to be regenerated is between 50 g/l and 90 g/l, with the presence of gluconate and sorbitol, and a molar ratio of Si/Al equal to 1), an optimal reduction in the aluminum concentration (>90%) is achieved, while the concentrations of sodium hydroxide and complexing agents remain substantially stable.

By contrast, regeneration processes with a sub-stoichiometric molar ratio of Si/Al (for example as in bath 4 in the table), for the same initial aluminum and sodium hydroxide concentrations in regeneration processes with a molar ratio of Si/Al equal to 1, would suffer from significantly lower aluminum recovery rates (<85%), which would negatively impact the cost-effectiveness of the process.

It is inferred that a regeneration method according to the invention, applied to a solution having the particular concentrations of aluminum, sodium hydroxide and complexing agents mentioned above, provides a yield not found in solutions with different characteristics.

In respect of the results in terms of regeneration of the milling solution, removal of aluminum and preservation of sodium hydroxide and complexing agents, a significant amount of white solid residue of zeolitic nature is then produced.

The invention claimed is:

1. A process for regenerating chemical milling solutions, comprising the steps of:

(a) in a solution containing sodium hydroxide (NaOH) in a concentration between 100 g/l and 250 g/l of solution, aluminum in a concentration between 40 g/l and 90 g/l of solution, and an aluminum complexing agent, comprising gluconate and sorbitol, each in a concentration between 5 g/l and 25 g/l of solution, wherein the ratio between the concentration of sorbitol in grams per liter of solution and the concentration of gluconate in grams per liter of solution is between 0.7 and 0.75, introducing a silicon-containing reagent into the solution in such a way as to establish a molar ratio of Si/Al equal to 1 in the solution; and (b) letting the silicon and aluminum in the solution to react, up at least to formation of a phase containing aluminosilicates.

2. The process of claim 1, wherein the silicon-containing reagent comprises elements selected from the group consisting of sodium silicate, organic and inorganic silicates, silica, aluminosilicate minerals, and colloidal silica.

3. The process of claim 1, wherein step (b) is carried out until at least part of the solution has an aluminum concentration between 40 g/l and 50 g/l.

4. The process of claim 1, wherein the solution and/or the phase containing aluminosilicates is maintained at a temperature between 60 °C and 100 °C for a time between 2 hours and 12 hours, until crystallization of a zeolite precipitate.

5. The process of claim 1, further comprising a step of mixing the solution.

6. The process of claim 1, comprising a solution filtration step, to separate the phase containing aluminosilicates from the solution.

7. The process of claim 1, wherein step (a) is carried out on a portion of the solution which contains an amount of aluminum such that, once removed, the overall concentration of the aluminum in the entire solution is lowered to a predetermined value.

* * * * *